US008708003B2

(12) United States Patent
Morris

(10) Patent No.: US 8,708,003 B2
(45) Date of Patent: Apr. 29, 2014

(54) SYSTEM FOR TRANSFERRING FILL MATERIAL

(76) Inventor: Grant Morris, Mt. Martha (AU)

( * ) Notice: Subject to any disclaimer, the term of this patent is extended or adjusted under 35 U.S.C. 154(b) by 1114 days.

(21) Appl. No.: 12/525,726

(22) PCT Filed: Feb. 11, 2008

(86) PCT No.: PCT/IB2008/001030

§ 371 (c)(1),
(2), (4) Date: Sep. 10, 2009

(87) PCT Pub. No.: WO2009/004416

PCT Pub. Date: Jan. 8, 2009

(65) Prior Publication Data

US 2010/0006177 A1 Jan. 14, 2010

(30) Foreign Application Priority Data

Feb. 13, 2007 (AU) ..... 2007100119

(51) Int. Cl.

| | |
|---|---|
| ***B65B 1/04*** | (2006.01) |
| ***B65B 1/18*** | (2006.01) |
| *B65D 33/25* | (2006.01) |

(52) U.S. Cl.

CPC ..... *B65B 1/18* (2013.01); *B65D 33/2591* (2013.01)

USPC ..... 141/10; 141/114; 141/313; 141/338; 383/36

(58) Field of Classification Search

USPC ..... 141/10, 114, 313–317, 338; 383/11, 36, 383/88–91, 904

See application file for complete search history.

(56) References Cited

U.S. PATENT DOCUMENTS

| | | | | |
|---|---|---|---|---|
| 172,039 | A * | 1/1876 | Lazarevitch | 383/36 |
| 177,749 | A * | 5/1876 | Redden | 383/36 |
| 2,653,744 | A * | 9/1953 | Behr | 141/10 |
| 3,228,444 | A * | 1/1966 | Weber et al. | 604/317 |
| 3,797,734 | A * | 3/1974 | Fleury et al. | 383/36 |
| 3,819,107 | A * | 6/1974 | Ryder, Jr. | 206/219 |
| 4,281,873 | A * | 8/1981 | Holland | 297/118 |
| 5,009,318 | A | 4/1991 | Lepinoy | |
| 6,209,962 | B1 | 4/2001 | Sobel et al. | |
| 6,334,227 | B1 | 1/2002 | Larger | |
| 6,527,444 | B1 * | 3/2003 | Buchman | 383/36 |
| 6,783,276 | B2 * | 8/2004 | Machacek et al. | 383/36 |
| 7,104,293 | B2 * | 9/2006 | Lais et al. | 141/302 |
| 7,331,840 | B2 * | 2/2008 | Amico, Jr. | 446/369 |
| 7,398,804 | B2 * | 7/2008 | Koch et al. | 141/315 |
| 7,909,071 | B2 * | 3/2011 | Denk et al. | 141/114 |

FOREIGN PATENT DOCUMENTS

| | | | |
|---|---|---|---|
| GB | 919054 | A1 | 2/1963 |
| JP | 200093260 | A1 | 4/2000 |

* cited by examiner

*Primary Examiner* — Timothy L Maust
(74) *Attorney, Agent, or Firm* — Hayes Soloway P.C.

(57) ABSTRACT

A two part system for transferring fill material in and out of soft furniture such as beanbag furniture, which comprises a transfer bag and a tubular funnel secured to the transfer bag and a second tubular funnel secured inside a piece of soft furniture to which the filling is to be transferred.

11 Claims, 5 Drawing Sheets

SYSTEM FOR TRANSFERRING FILL MATERIAL

FIELD OF THE INVENTION

This invention relates to a system for transferring filling from soft furniture, such as beanbags, making it far easier, safer and less messy than any current method to fill or empty such furniture.

BACKGROUND TO THE INVENTION

The market for fashionable, affordable, soft furnishings such as beanbags is one of the fastest growing sectors in the home furnishings market worldwide. These types of products are a cheaper alternative to conventional "hard-frame" furniture, yet are seen as trendy and cool by young home makers. Beanbags are amazingly comfortable, enabling the user to mould the seat to their body shape, giving total support in either the supine or seated positions. In recent times, many of the products have evolved from the old "blob" style furniture into modern items that will enhance any decor.

With apartment living growing rapidly and society becoming more and more mobile (most people will now change households approximately every three and a half years), the portability of soft-filled products such as beanbags is becoming more attractive.

Problems with Prior Art Beanbags

Most beanbags are filled with polystyrene beads that offer the benefits of being low cost, highly fire-retardant and having a "springiness" that holds its shape for long periods of heavy use, affording a high degree of comfort. The downside is that they are difficult to obtain (only a few major chain stores carry them, and even then in only their larger outlets), difficult to transport and very messy to transfer from their packing into the furniture.

After the customer purchases the several bags of polystyrene beads (usually just called "beans"), they will need, they find that they often will not fit in the car boot but are crammed in with the kids for transport home, often resulting in ripped plastic bags that fill every crevice of the car with polystyrene beads. Once home, they will usually need three adults to help fill their beanbags, two to hold the beanbag and one to empty the beans into it. It is virtually impossible to undertake this task without spilling large volumes of beans, which quickly float on the slightest air current to heater vents, under furniture, into toy boxes and every nook and cranny of the house. People often continue to find these maverick beans for years after the original filling saga.

When the soft furniture needs to be washed the beans must again be decanted from it, stored whilst the cover is washed, then somehow transferred back into the furniture. (Most people try to use the bath as a temporary storage receptacle, usually with snowstorm-like results).

Whilst this is sometimes seen as humorous, in reality it is far from funny. Before the introduction of the Australian Standards for beanbags, requiring childproof zippers on these products, there were several incidents reported of children who had opened the zippers and inhaled the beans, blocking their airways, causing choking and, in some cases, death. Since the Standards were introduced, there have been no deaths reported. However, there have been many incidents recorded by hospitals involving children picking up and swallowing/inhaling stray beans after spillage occurred when filling. This is simply not acceptable.

The Problem

The need is for a system that will allow users to purchase filling (such as polystyrene beans) in convenient packs that can be easily and quickly used to transfer the filling (such as polystyrene beans) into (or out on the beanbags, with little or no spillage, yet needing only one person to undertake the transfer.

The Invention

This invention provides a two-part system for transferring fill material in and out of soft furniture, such as beanbag furniture. This is comprised of an external transfer bag (called a Funnelweb bag) with a tubular funnel or gusset secured to a secondary tubular funnel or gusset located within the piece of soft furniture (such as a beanbag).

The present invention also provides a method of transferring fill material in and out of soft furniture such as beanbag furniture, the method comprising extending a tubular funnel from the soft furniture into engagement with a tubular funnel provided in a bag of fill material so that fill material may be transferred between the soft furniture and the bag without spillage.

DETAILED DESCRIPTION OF THE INVENTION

Turning to the accompanying drawings.

Figure 6:
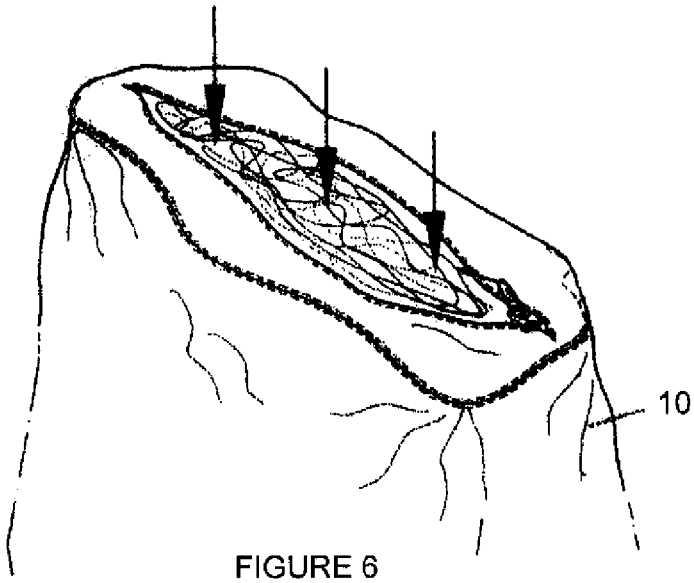
FIG. 6 illustrates the process of FIGS. 4 and 5 at a stage at which the transfer bag of FIG. 2 is removed from the article of FIG. 1.
Figure 7:
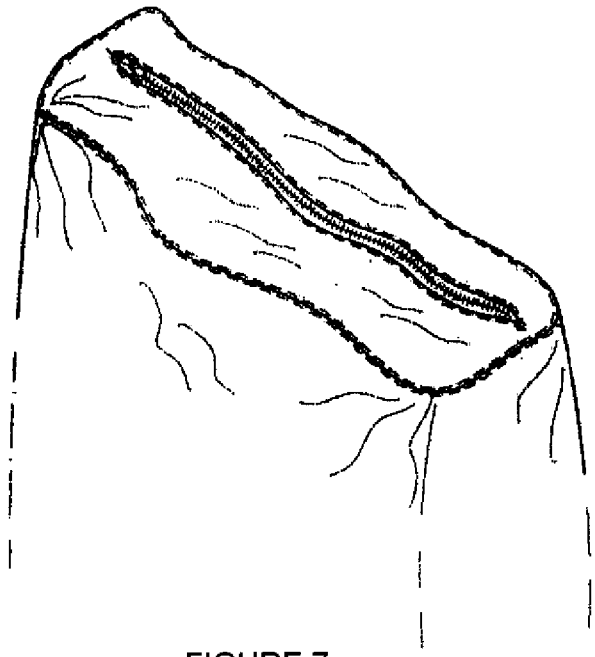

FIG. 7 in this article is FIG. 6 zipped up.

Figure 1:
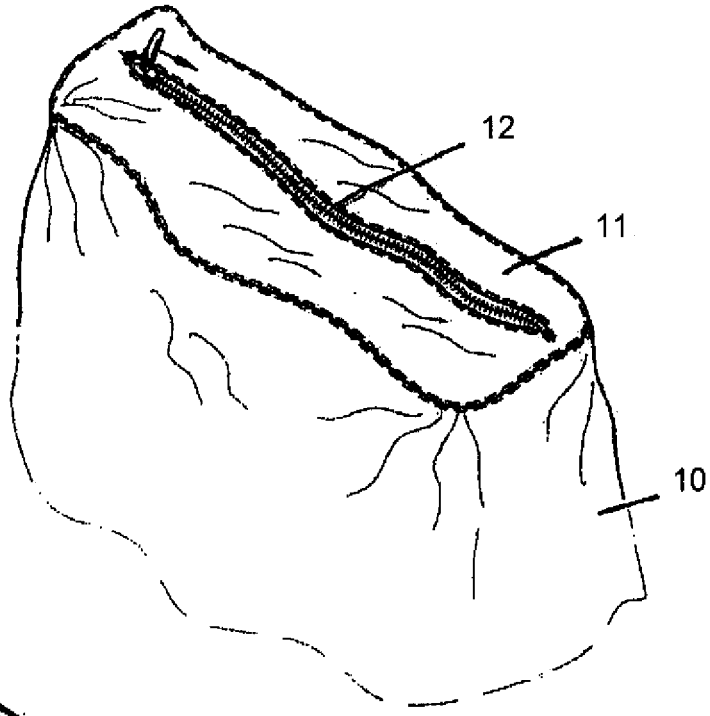
FIG. 1 illustrates a portion of an article of soft furniture to be filled.

Turning to FIG. 1, article of soft furniture 10 is provided with an exemplary upper face 11, which is provided with a zipper 12.

Figure 2:
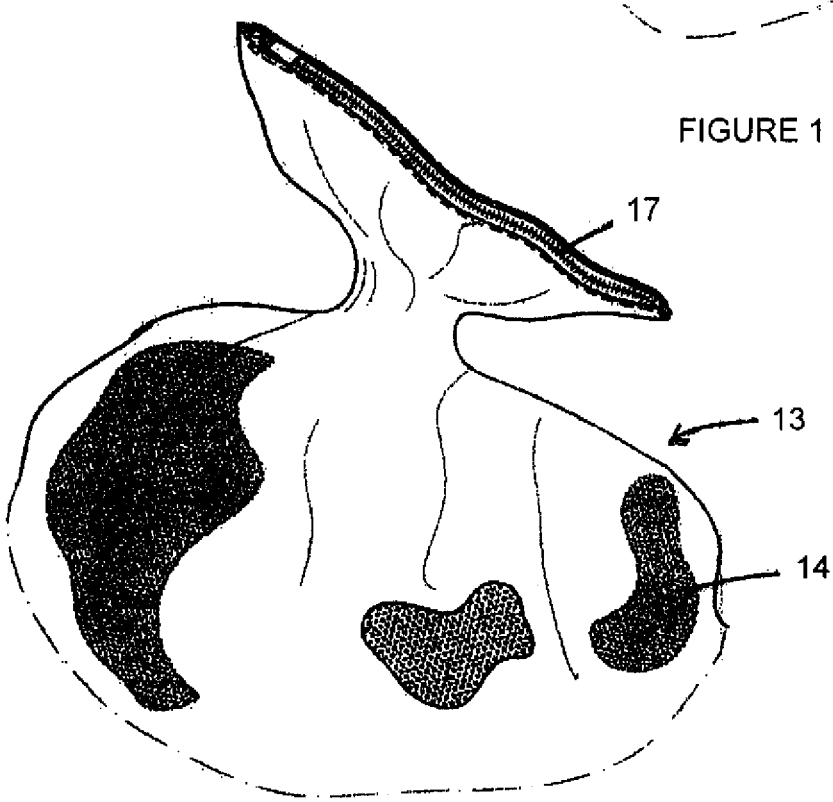
FIG. 2 illustrates an external bag of filling (a "transfer" bag)

The bag of filling 13 of FIG. 2 holds a multiplicity of polystyrene beans or other fill.

There is a zipper 17 at the end of the bag.

Figure 3:
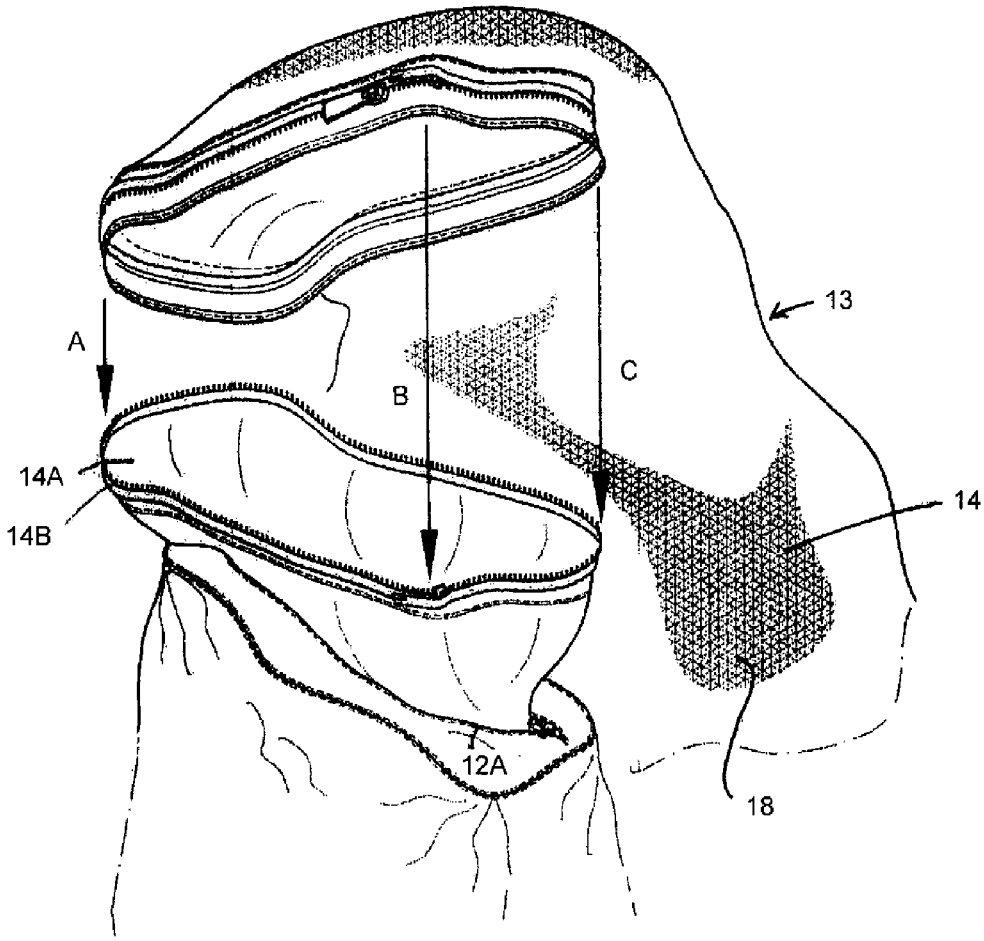
FIG. 3 illustrates the bags of filling of FIG. 2 ready to be attached to the article of FIG. 1.

Turning to FIG. 3, this shows how the article of soft furniture 10 fits to the external transfer bag of filling 13 by placing it downwards in the direction A, B, C. Numeral 14A refers to the mouth of the article of soft furniture 10 (to which it is secured) through the mouth 12A so that contents of soft furniture 10 may be filled. Numeral 14B refers to a zip fastener and numeral 12 to a longitudinal hole in the top 11 of the article of soft furniture (see FIG. 1, article 10).

Returning to the external bag of filling, 13 and 17 have meanings as before; Numeral 18 refers to the mass of filling in the bag 17. Letters A, B and C refer to the direction of motion of bag 13 with regard to the article of soft furniture 10.

Figure 4:
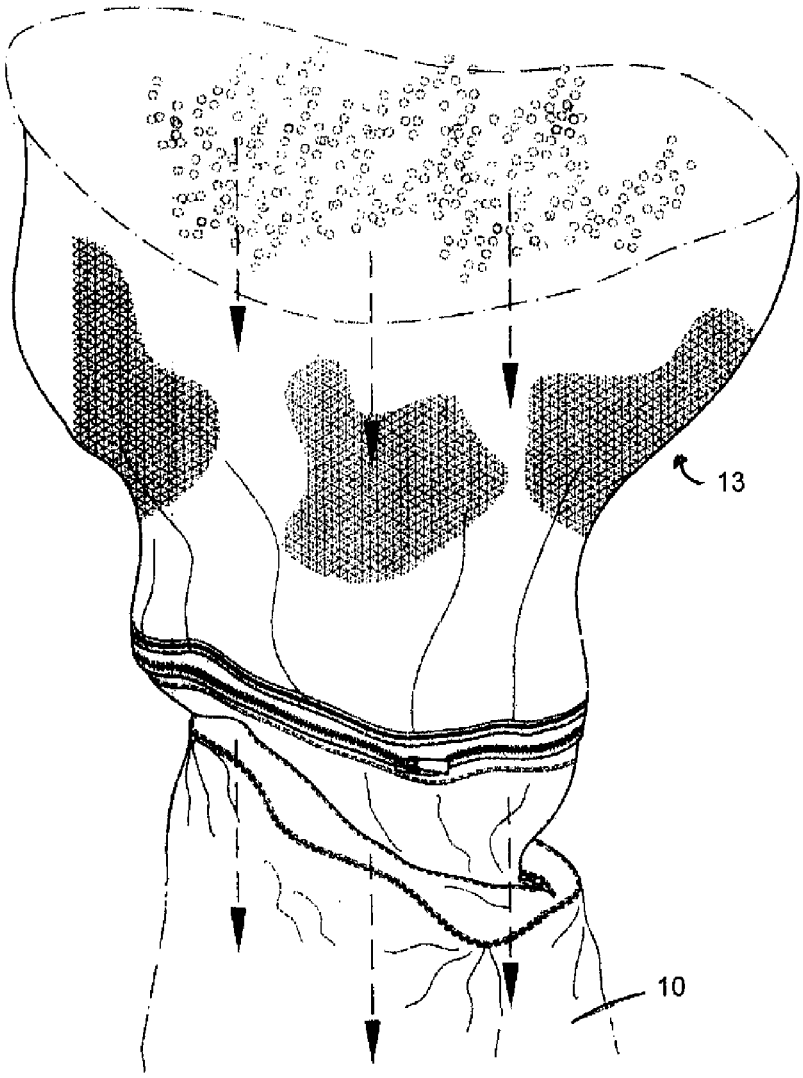
FIG. 4 illustrates the bag of filling of FIG. 2 attached to the article of FIG. 1 and in the process of transferring filling.

Turning to FIG. 4, this figure shows the bag of filling 13 in a more advanced position than in FIG. 3 with some filling having been injected into soft furniture 10.

Figure 5:
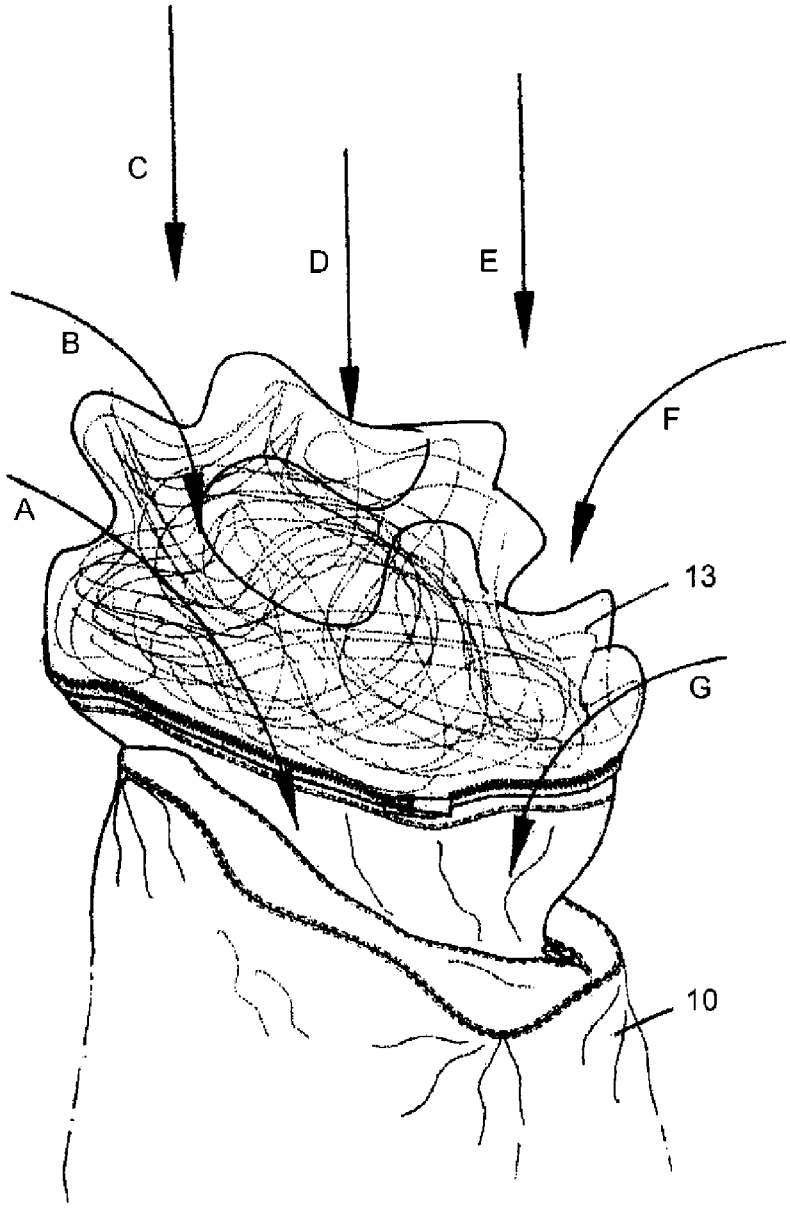
FIG. 5 illustrates the process of FIG. 4 at a more advanced stage.

Turning to FIG. 5, this shows an article of soft furniture 10 almost completely filled and the external transfer bag 13 almost collapsed. Arrows A to G indicate the flow of fill into article of soft furniture 10.

FIG. 6 shows the completion of filling up the article of soft furniture 10 and FIG. 7 the close of the zip fastener to complete the process.

It should be noted that the external transfer bag 13 may be maintained separate from article of furniture 10.

Furthermore, there may be two zip access to the beanbag, maintaining a greater degree of security from tampering by children.

The zipper may be replaced by Velcro elements.

The advantages of the system according to the invention are that:

It is far quicker and easier to fill an item of soft furniture;

There is little or no spillage of fill material;

Filling can be carried out easily by one person;

It is far safer around children;

By virtue of two zips or Velcro system, access to the soft furniture is a double barrier to child access; and The transfer bag may be used for storing filling whilst the cover is being washed.

The invention claimed is:

1. A method of transferring fill material in and out of soft furniture, the method comprising extending a first tubular funnel from the soft furniture into engagement with a second tubular funnel provided in the bag of fill material so that fill material may be transferred between the soft furniture and the bag without, spillage, wherein a first fastening system is located on an end of the first tubular funnel and a second fastening system is located on an end of the second tubular funnel, the second fastening system independent of the first fastening system, and wherein when the first and second fastening systems are connected together by use of at least one of a two-part zipper and a hook and loop fastener system.

2. A two-part system for transferring fill material in and out of soft furniture, comprising:

a transfer bag and a first tubular funnel secured to the transfer bag, wherein a first fastening system is located on an end of the first tubular funnel; and a second tubular funnel secured inside a piece of soft furniture to which the filling is to be transferred, wherein a second fastening system is located on an end of the second tubular funnel, the second fastening system independent of the first fastening system, wherein the first and second tubular funnels are joined together when the first and second fastening systems are connected together by use of at least one of a two-part zipper and a hook and loop fastener system.

3. A two-part system according to claim 2, wherein the first tubular funnel, which can be secured to the transfer bag, forms at least part of the mouth of the bag.

4. A two-part system according to claim 2, wherein the soft furniture has a closable opening through which the second tubular funnel may be pulled in order to effect transfer of fill material.

5. A two-part system according to claim 2, wherein the funnels are made of a flexible material.

6. A two-part system according to claim 2, wherein the first tubular funnel, which can be secured to the transfer bag, forms at least part of the mouth of the bag.

7. A two-part system according to claim 2, wherein the soft furniture has a closable opening through which the second tubular funnel may be pulled in order to effect transfer of fill material.

8. A two-part system according to claim 3, wherein the soft furniture has a closable opening through which the second tubular funnel may be pulled in order to effect transfer of fill material.

9. A two-part system according to claim 2, wherein the first and second tubular funnels are made of a flexible material.

10. A two-part system according to claim 3, wherein the first and second tubular funnels are made of a flexible material.

11. A two-part system according to claim 4, wherein the first and second tubular funnels are made of a flexible material.

* * * * *